US006692138B2

(12) United States Patent
Chornenky

(10) Patent No.: US 6,692,138 B2
(45) Date of Patent: Feb. 17, 2004

(54) ILLUMINATION DISPLAY DEVICE WITHOUT MIRRORS

(76) Inventor: Todd E. Chornenky, 125 Cambridge Rd., Bethel Park, PA (US) 15102

( * ) Notice: Subject to any disclaimer, the term of this patent is extended or adjusted under 35 U.S.C. 154(b) by 0 days.

(21) Appl. No.: 10/075,133

(22) Filed: Dec. 5, 2001

(65) Prior Publication Data

US 2002/0075681 A1 Jun. 20, 2002

Related U.S. Application Data

(60) Provisional application No. 60/251,419, filed on Dec. 5, 2000.

(51) Int. Cl.[7] ..... F21S 13/14

(52) U.S. Cl. ..... 362/252; 362/249; 362/251; 40/442; 40/452

(58) Field of Search ..... 362/140, 241, 362/252, 811, 227, 235, 236, 237, 249, 250, 251, 135, 806, 807, 808; 359/616; 353/1; 40/442, 452, 427, 444, 446

(56) References Cited

U.S. PATENT DOCUMENTS 1,034,478 A * 8/1912 McComb ..... 359/616
2,210,718 A * 8/1940 Henninger, Jr. et al. ..... 40/442
2,493,238 A * 1/1950 Eddy ..... 353/1
3,501,217 A * 3/1970 Bottani ..... 359/616
3,651,319 A * 3/1972 Norris et al. ..... 362/232
3,694,645 A * 9/1972 Brantz ..... 40/432
4,164,823 A * 8/1979 Marsico ..... 362/140
4,809,584 A * 3/1989 Forrest ..... 84/464 R
4,920,467 A * 4/1990 Honsberger ..... 40/452
5,276,599 A * 1/1994 Neeley ..... 362/301

* cited by examiner

*Primary Examiner*—Alan Cariaso
*Assistant Examiner*—Ismael Negron
(74) *Attorney, Agent, or Firm*—James Ray & Associates

(57) ABSTRACT

An apparatus which provides a substantially planar display device. Such apparatus including a predetermined plurality of sets of lights. Each of such predetermined plurality of sets of lights including an even number of lights connected to one circuit to be simultaneously energized thereby. The lights in such set being disposed in a substantially symmetrical array having at least four mirror axes and an energization device connected to such predetermined plurality of such sets of lights for energizing BP predetermined plurality of such sets of lights in an apparently random manner.

14 Claims, 6 Drawing Sheets

Note: In this example, lamp sets 2 and 5 are temporarily lit. All other lamp sets are off. ○ designates lamp on.

ILLUMINATION DISPLAY DEVICE WITHOUT MIRRORS

CROSS-REFERENCE TO RELATED APPLICATION

This application is related to U.S. Provisional Patent Application Ser. No. 60/251,419 and was filed on Dec. 5, 2000.

FIELD OF THE INVENTION

The present invention relates, in general, to an illuminated kaleidoscope device and, more particularly, this invention relates to an illuminated electronic kaleidoscope device having substantially symmetrical groups of lights flashing in an apparently random manner.

BACKGROUND OF THE INVENTION

Prior to the conception and development of the present invention, kaleidoscopes were generally well known in the prior art. These prior art type kaleidoscopes usually employ two or more mirrors which are mounted in an angular relationship to provide a plurality of symmetrical images. A typical kaleidoscope consists of a tube like member having a pair of angled mirrors. A viewing -port is disposed at one thereof and a chamber containing a predetermined plurality of bits of colored glass is disposed at the other end thereof.

An electrical kaleidoscope is described in U.S. Pat. No. 1,034,478: titled "Kaleidoscope". This kaleidoscope is a tube having angled mirrors. A view port is disposed at one end thereof, and a display of flashing lights is disposed at the other end thereof.

SUMMARY OF THE INVENTION

The present invention provides a display of lights having a predetermined plurality of intersecting mirror axes, or mirror planes. It consists of a predetermined plurality of sets of lights. All the lights in the set having symmetry according to the mirror axes or planes. All the lights in a set are simultaneously turned on and off by a predetermined energization system. Additionally, the sets may be turned on and off independently and they may be turned on and off in an apparently random manner, or in accordance with an acoustic signal.

OBJECTS OF THE INVENTION

It is, therefore, one of the primary objects of the present invention to provide an illuminated electrical display device having a predetermined plurality of symmetrically placed lights which flash in at least one of a random and a pseudo random fashion.

Another object of the present invention is to provide a substantially continuously changing planar electronic kaleidoscope device.

Still another object of the present invention is to provide an electronic kaleidoscope device which has a relatively simple circuit.

Yet another object of the present invention is to provide an illuminated electronic display device having lights which will flash in accordance with the beat of ambient music.

A further object of the present invention is to provide an illuminated electronic display device having colored lights flashing in accordance with ambient music and in which the colors of the lights will depend on the pitch of the music.

An additional object of the present invention is to provide an illuminated electronic display device which is relatively inexpensive to manufacture.

Still yet another object of the present invention is to provide an illuminated electronic display device which is relatively maintenance free.

It is a further object of the present invention to provide an illuminated electronic display device which is relatively simple to operate.

In addition to the various objects and advantages of the present invention which have been described in some detail above, it should be obvious that various additional objects and advantages of the invention will become more readily apparent to those persons who are skilled in the relevant art from the following more detailed description of the invention, particularly, when such description is taken in conjunction with the attached drawing figures and with the appended claims.

Figure 1:
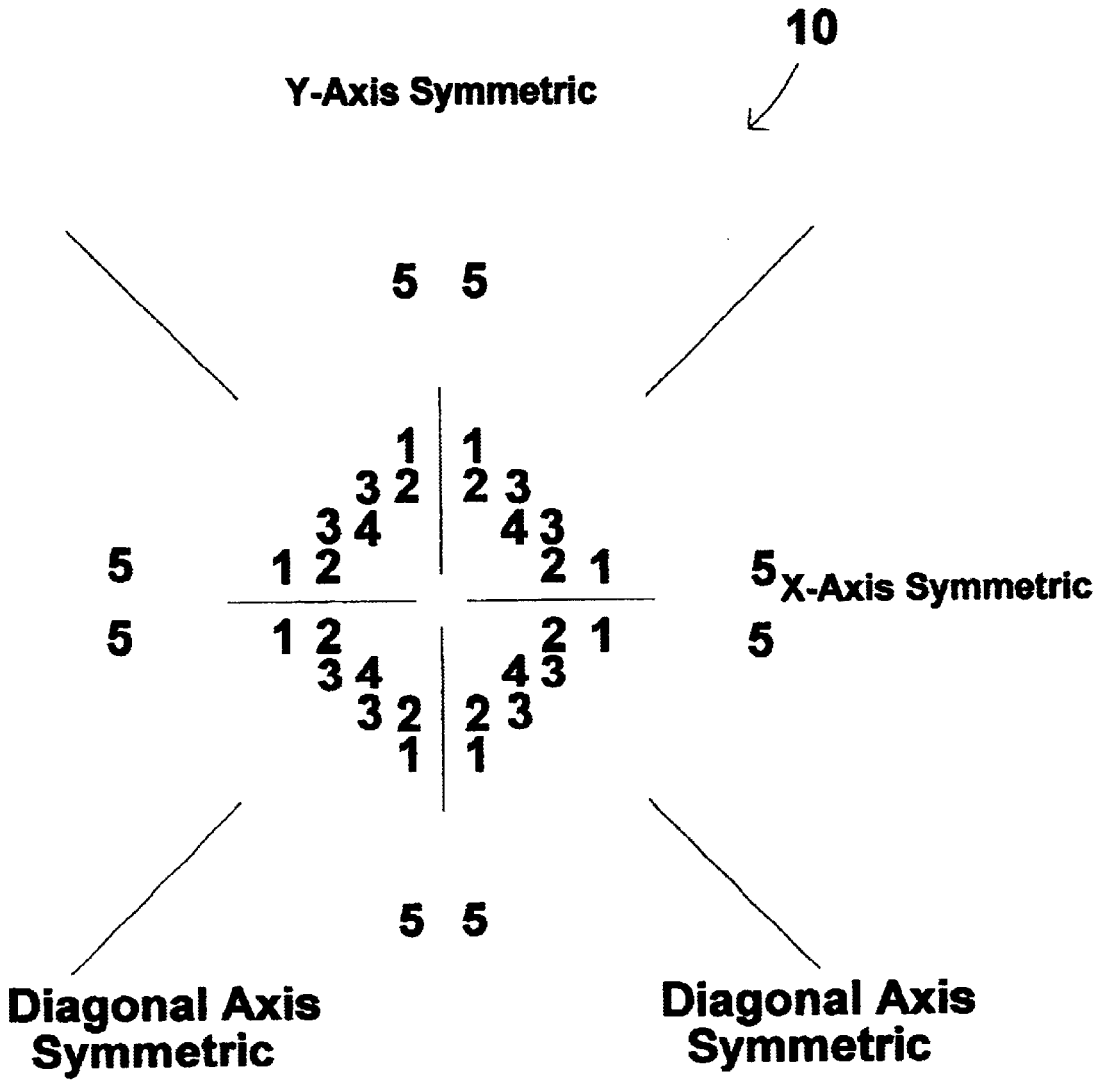
FIG. 1 is a schematic diagram illustrating the placement of five groups of lights laid out in a substantially symmetrical pattern and having four mirror axes according to one presently preferred embodiment of the invention.

BRIEF DESCRIPTION OF THE PRESENTLY PREFERRED AND VARIOUS ALTERNATIVE EMBODIMENTS OF THE INVENTION

Prior to proceeding to more detailed description of the present invention it should be noted that identical components which have identical functions have been identified with identical reference numerals throughout the several views illustrated in the attached drawings for the sake of clarity and understanding of the present invention.

Attention is now directed, more particularly, to FIG. 1. Schematically illustrated therein is_a substantially planar display, generally designated 10, of sets of lights. Such light sets (or sets of lights) are indicated by the numerals 1 through 5. All the lights in light set 1, are energized by a single circuit. In this manner, all of the lights in light set 1 may be turned on and off simultaneously. Likewise, all of the lights in light set 2 are energized by another circuit so that they may be turned on and off simultaneously. The same is true for all the sets of lights, 1 through 5.

According to the present invention the symmetry of the light sets 1 through 5 will be based on at least two substantially mirror axes. It should be understood, however, that each of the light sets 1 through 5 has a symmetry that can be based on four substantially mirror axes or more axes. These axes are the X-axis, the Y-axis and the two diagonal axes.

Figure 2:
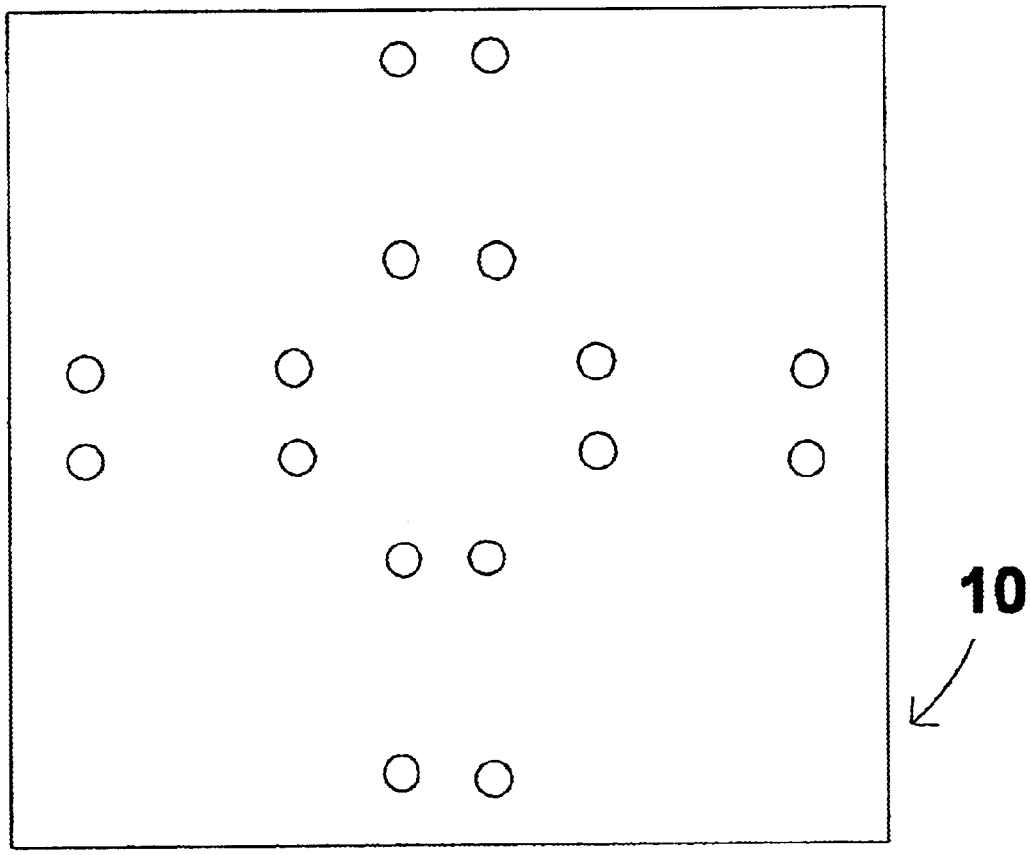
FIG. 2 is a schematic diagram illustrating the positions of two of the five groups of lights illustrated in FIG. 1.
Figure 3:
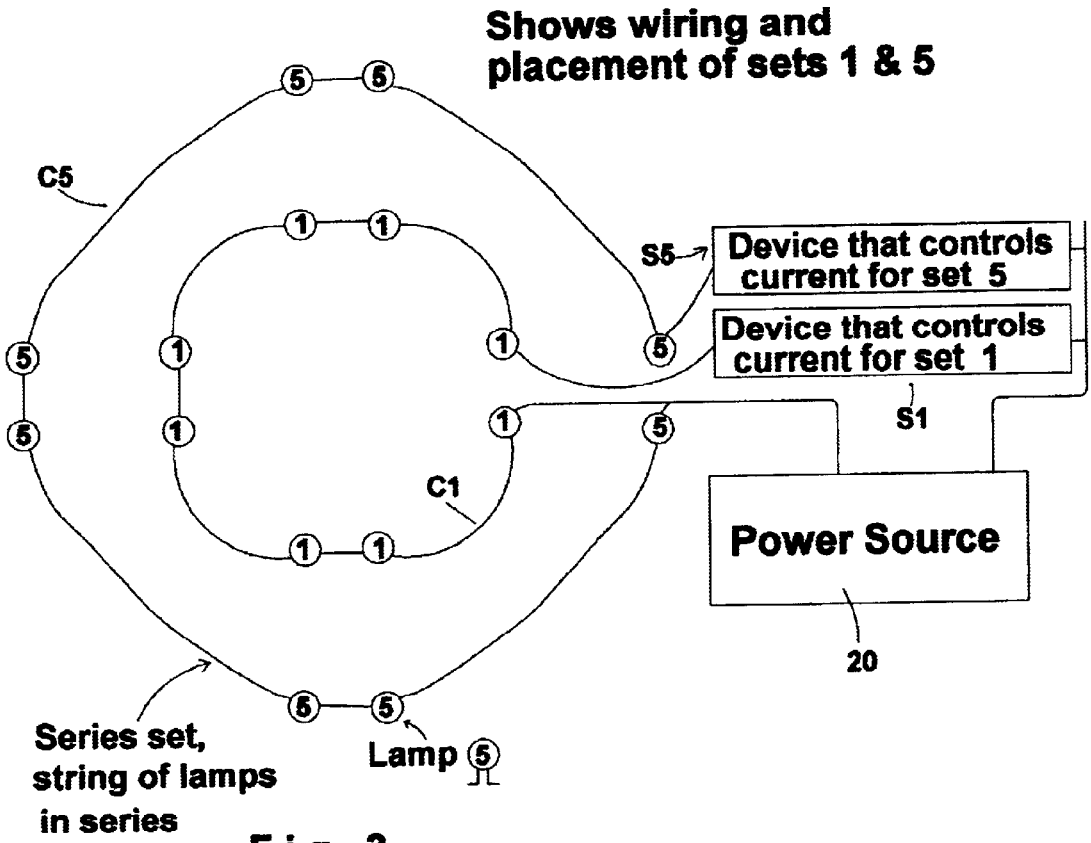
FIG. 3 is a schematic diagram which illustrates a circuit for energizing the two groups of lights illustrated in FIG. 2.

FIG. 2 illustrates light sets 1 and 5 of planar display 10 and FIG. 3 schematically illustrates the circuitry for energizing the circuits for light sets 1 and 5. All of the lights in set 1 are energized by a single circuit, generally designated C1. In the circuit C1 shown, they are all in series. As would be recognized by persons skilled in_the art, should one light be burned out the remaining lights in the display would be unlit. However, it is apparent that such symmetry would be maintained though such lights would be unlit.

If desired, they could also all be in parallel in a single circuit. In the presently preferred embodiment of the invention, circuit C1 is controlled by a switch means, generally designated S1, which receives energy from a power supply, generally designated 20. Likewise, all the lights in set 5 are energized by a single circuit, a generally designated C5. Circuit C5 is controlled by switch means, generally designated S5, which also receives energy from power supply 20.

The switch means S1 and S5 may be periodic on/off devices which, since they are not coordinated with each other, cause the light sets 1 and 5 to appear to flash randomly. The on/off switching may be provided, for example, by resistive heaters and thermal switches, or by resistor-capacitor-discharge bulb combinations. Such art is generally well known, for example, for turn signals for vehicles.

Figure 4:
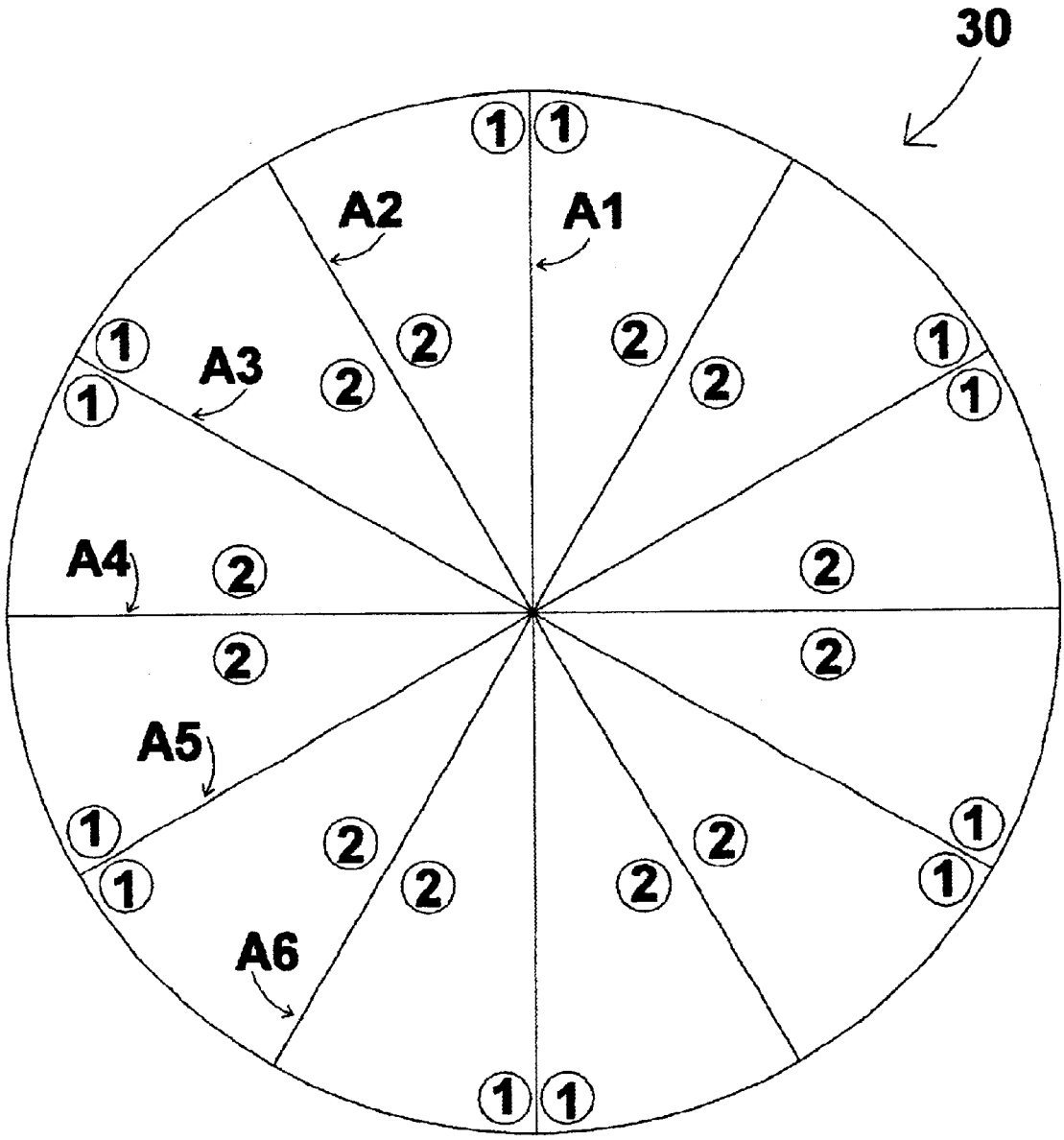
FIG. 4 is a schematic diagram illustrating the positions of two groups of lights in an alternative embodiment of the invention having six mirror axes.

Reference is now made, more particularly, to FIG. 4. Illustrated therein is the presently preferred embodiment of a substantially planar display, generally designated 30. Display 30 has six mirror axes denoted A1, A2, A3, A4, A5 and A6. Two sets of lights are shown, light set 1 and light set 2. These would be controlled by independent circuits, similarly to the lights in display 10.

Figure 5:
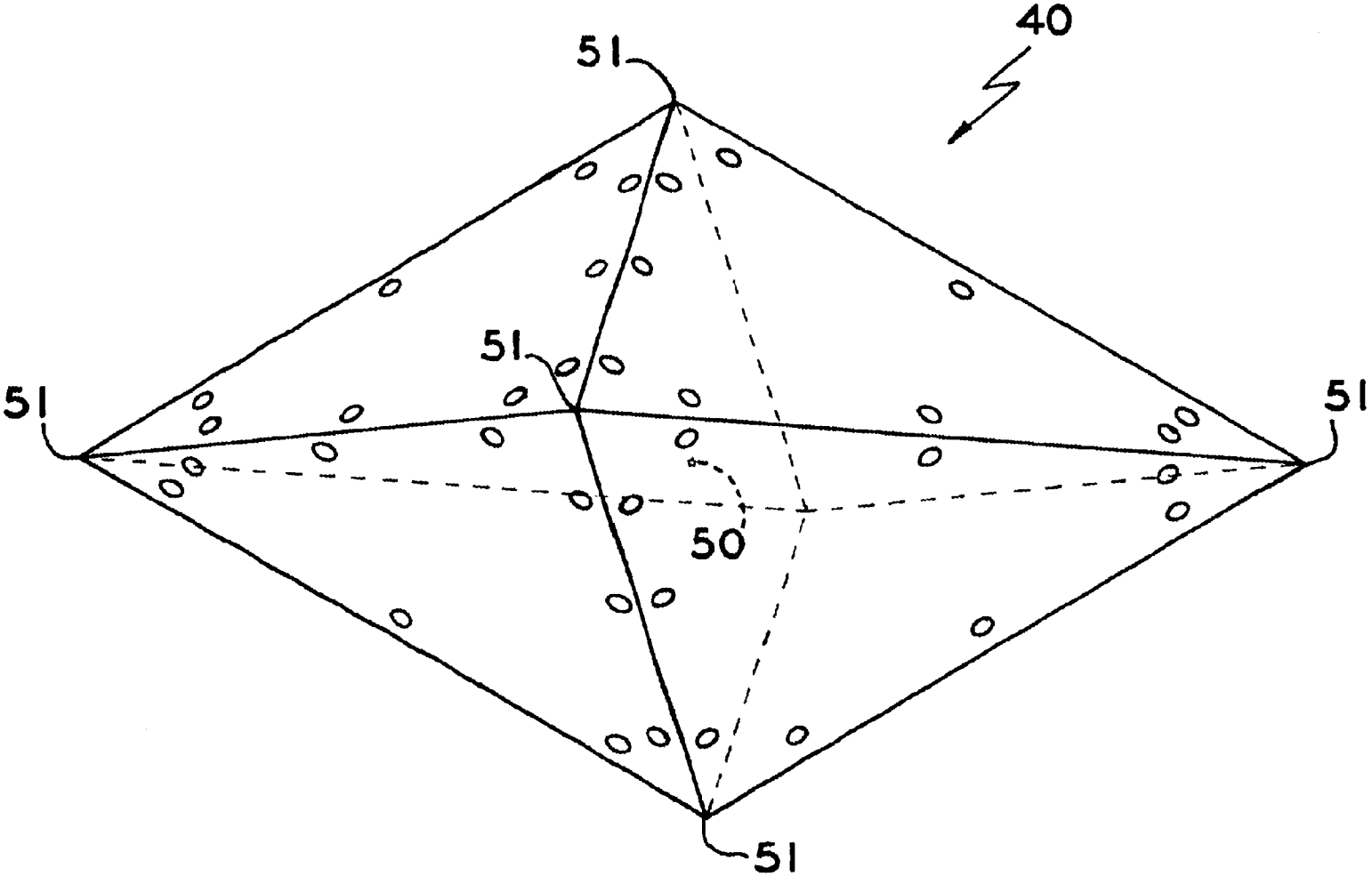
FIG. 5 is a schematic diagram illustrating the positions of two sets of lights in a three dimensional display having octahedral symmetry.

FIG. 5 illustrates a three dimensional array of lights, generally designated 40, having an octahedral symmetry. Any two corner points 51 combined with the center point 50 define a substantial mirror plane of array 40. Two sets of lights are shown, light set 1 and light set 2. These would be controlled by independent circuits, similarly to the lights in display 10.

Other types of three dimensional arrays may be defined from the art of crystallography and from the geometry of regular polyhedral.

Figure 6:
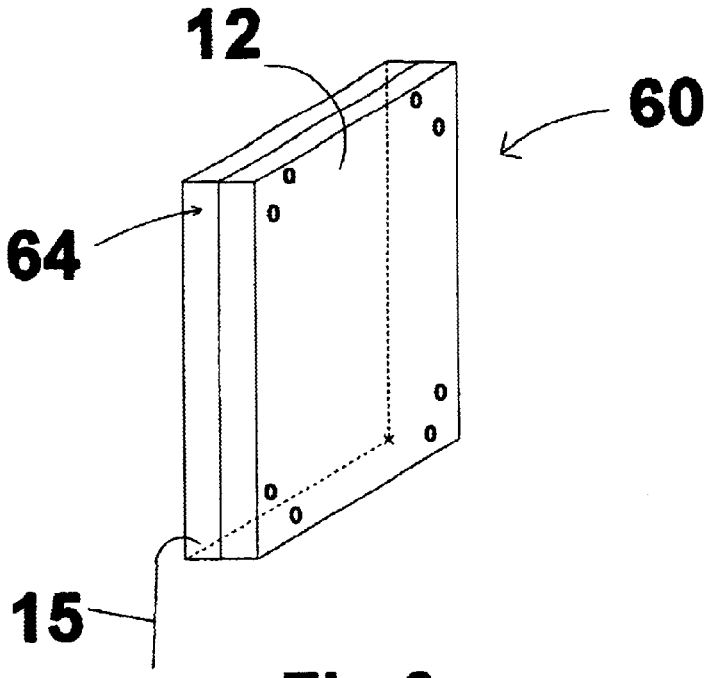
FIG. 6 is a schematic diagram illustrating a display having an audio signal line for controlling illumination of lights according to the present invention.
Figure 7:
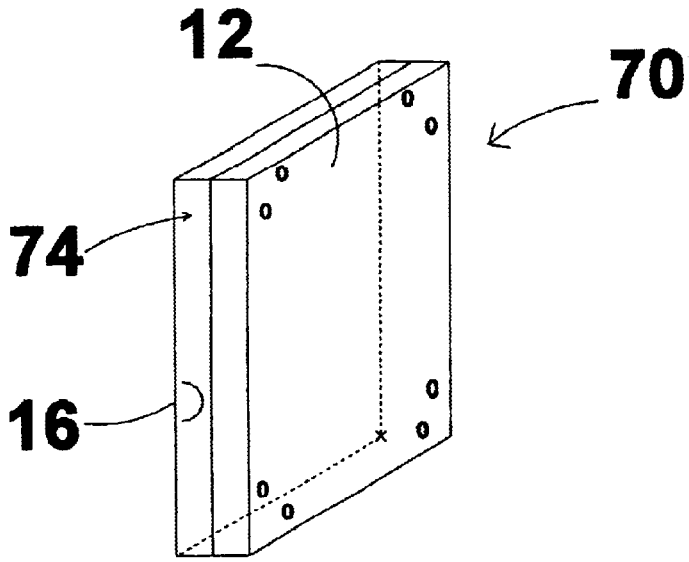
FIG. 7 is a schematic diagram illustrating a display device, according to an alternative embodiment of the invention, having a microphone for receiving an acoustic signal from the environment of the display device.

FIGS. 6 and 7 illustrate displays, generally designated 60 and 70, controlled by acoustic signals. Display 60 includes a bulb array 12 and circuitry 64. Display 60 further includes an acoustic signal line 15 which is for connection to an audio system.

FIG. 7 illustrates a display, generally designated 70, and circuitry 74 which has a microphone 16 which receives an acoustic signal from the ambient environment.

Circuitry 64 and 74 energize the circuits for the bulbs in accordance with characteristics, such as frequency and loudness of the acoustic signal. For example, blue bulbs in display 12 may be illuminated when high frequency sounds are received, red bulbs in display 12 may be illuminated when low frequency sounds are received.

Hence, when the acoustic signal is a musical signal, display 60 or display 70 are illuminated in accordance with the beat and the frequencies of the music.

Any type of light or bulb may be used, including incandescent bulbs, light emitting diodes, electro luminescent devices, gaseous discharge bulbs or tubes, etc.

The displays 10, 30, 40, 60 and 70 described in this patent may further include advertising displays.

While a presently preferred and various additional alternative embodiments of the instant invention have been described in detail above in accordance the patent statutes, it should be recognized that various other modifications and adaptations of the invention may be made by those persons who are skilled in the relevant art without departing from either the spirit of the invention or the scope of the appended claims.

I claim:

1. An illumination device, said illumination device comprising:

(a) a support member;

(b) a predetermined plurality of sets of lights disposed one of on and in said support member, each of said predetermined plurality of sets of lights including an even number of lights connected to one circuit to be simultaneously energized thereby, said lights in said sets being disposed in a substantially symmetrical array having at least two substantially mirror axes, thereby producing an effect similar to reflected light without requiring use of mirrors; and (c) an energization means connected to said predetermined plurality of sets of lights for energizing said predetermined plurality of sets of lights in an apparently random manner.

2. An illumination device, according to claim 1, wherein said illumination device has at least four substantially mirror axes.

3. An illumination device, according to claim 1, wherein said illumination device has at least six substantially mirror axes.

4. An illumination device, according to claim 1, wherein said energization means includes separate energization circuits for each set of said predetermined plurality of said sets of lights, each of said energization circuits turning said predetermined plurality of said sets of lights in said set on and off.

5. An illumination device, according to claim 4, wherein each of said energization circuits turn said lights in said set on and off in a generally periodic manner independently of energization of other ones of said predetermined plurality of said sets of lights.

6. An illumination device, according to claim 5, wherein at least one of said energization circuits includes, a thermal timer for timing said periodic energization.

7. An illumination device, according to claim 5, wherein at least one of said energization circuits includes a resistor and a capacitor for timing said periodic energization.

8. An illumination device, according to claim 7, wherein said illumination device has at least four substantially mirror axes.

9. An illumination device, according to claim 7, wherein said illumination device has at least six substantially mirror axes.

10. An illumination display device said predetermined plurality of lights having at least four mirror axes, said illumination display device comprising:

(a) a predetermined plurality of sets of lights, each of said predetermined plurality of lights including;

(b) an even number of lights connected to one circuit to be simultaneously energized thereby, said lights in said set being disposed in a substantially symmetrical array having at least two substantially mirror axes, thereby producing an effect similar to reflected light without requiring use of mirrors; and (c) a means connected to said circuit for receiving an acoustic signal and for energizing said sets of lights in accordance with predetermined characteristics of said acoustic signal.

11. An illumination display device, according to claim 10, wherein each of said predetermined plurality of said sets of lights is energized by different characteristics of said acoustic signal.

12. An illumination display device, according to claim 11, wherein said acoustic signal is obtained by a direct connection to an audio system.

13. An illumination display device, according to claim 11, wherein said acoustic signal is obtained from a microphone included in said illumination display device.

14. An illumination display device, said illumination display device comprising:

(a) a predetermined plurality of sets of lights disposed one of on and in said support member, each of said predetermined plurality of sets of lights having an even_ number of lights connected to one circuit to be simultaneously energized thereby, said lights in said sets being disposed in a symmetrical array having a plurality of substantially mirror planes, said substantially mirror planes intersecting at a point thereby producing an effect similar to reflected light without requiring use of mirrors; and (b) an energization means connected to said sets of lights for to meet this energizing said predetermined plurality of said sets of lights in an apparently random manner symmetrical array having at least two substantially mirror axes, thereby producing an effect similar to reflected light without requiring use of mirrors; and (c) an energization means connected to said predetermined plurality of sets of lights for energizing said predetermined plurality of sets of lights in an apparently random manner.

* * * * *